US010045644B2

(12) United States Patent
Uitbeijerse et al.

(10) Patent No.: US 10,045,644 B2
(45) Date of Patent: Aug. 14, 2018

(54) COVER DEVICE FOR A DRINK CONTAINER

(71) Applicant: KONINKLIJKE PHILIPS N.V., Eindhoven (NL)

(72) Inventors: Bastiaan Uitbeijerse, Eindhoven (NL); Wiecher Ferdinand Kamping, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/316,873

(22) PCT Filed: Jun. 4, 2015

(86) PCT No.: PCT/IB2015/054226

§ 371 (c)(1),
(2) Date: Dec. 7, 2016

(87) PCT Pub. No.: WO2015/189748

PCT Pub. Date: Dec. 17, 2015

(65) Prior Publication Data

US 2017/0095098 A1 Apr. 6, 2017

Related U.S. Application Data

(60) Provisional application No. 62/011,353, filed on Jun. 12, 2014.

(51) Int. Cl.

| | |
|---|---|
| ***A47G 19/22*** | (2006.01) |
| ***B65D 47/06*** | (2006.01) |
| ***B65D 47/20*** | (2006.01) |

(52) U.S. Cl.
CPC ..... *A47G 19/2272* (2013.01); *B65D 47/06* (2013.01); *B65D 47/2031* (2013.01)

(58) Field of Classification Search
CPC ..... A47G 19/2272; A47G 19/2266; A47G 19/2205; A47G 19/22; B65D 47/00;
(Continued)

(56) References Cited

U.S. PATENT DOCUMENTS 3,159,176 A * 12/1964 Russell ..... B60T 11/28 137/493.1
3,941,149 A * 3/1976 Mittleman ..... A61M 39/24 137/493.1

(Continued)

FOREIGN PATENT DOCUMENTS

WO 9817157 A1 4/1998
WO 2014086625 A1 6/2014

*Primary Examiner* — Steven A Reynolds
*Assistant Examiner* — Javier A Pagan

(57) ABSTRACT

A cover device (2) for a drink container comprises a basic assembly (9) which is provided with a drink opening (32), and a valve arrangement (20) for blocking or unblocking a passage to the drink opening (32) from a drink container side of the cover device (2). The valve arrangement (20) comprises a valve element (26) having two portions (27, 28) which are connected to each other through an area of the valve element (26) at a position where the valve element (26) is hingably associated with the basic assembly (9), the valve element (26) has a slit (42), and at least one of the valve element (26) and the connecting member (37) is shaped in such a way that the tighter the valve element (26) is pushed onto the connecting member (37), the more firmly the slit (42) is closed.

6 Claims, 5 Drawing Sheets

(58) Field of Classification Search
CPC .... B65D 47/04; B65D 47/06; B65D 47/2018; B65D 47/2031
USPC ..... 220/711, 713, 714, 719
See application file for complete search history.

(56) References Cited

U.S. PATENT DOCUMENTS

| | | | | | |
|---|---|---|---|---|---|
| 4,711,365 | A * | 12/1987 | Fomby | B65D 41/0428 | 215/329 |
| 5,890,621 | A * | 4/1999 | Bachman | A47G 19/2272 | 215/11.4 |
| 6,357,620 | B1 * | 3/2002 | Hakim | A47G 19/2272 | 215/11.4 |
| 6,923,224 | B1 * | 8/2005 | McClung | B60K 15/035 | 141/350 |
| 7,556,172 | B2 * | 7/2009 | Lane | A47G 19/2272 | 215/11.5 |
| 8,561,851 | B1 * | 10/2013 | Leonoff | B65D 47/243 | 137/847 |
| 8,678,228 | B2 * | 3/2014 | Steininger | B65D 47/20 | 215/11.1 |
| 8,967,412 | B2 * | 3/2015 | Loging | A47G 19/2272 | 206/219 |
| 9,138,088 | B2 * | 9/2015 | Kemper | A47G 19/2272 | |
| 9,650,183 | B2 * | 5/2017 | Chen | B65D 47/06 | |
| 2007/0138121 | A1 * | 6/2007 | Stribling | A47G 19/2272 | 215/11.4 |
| 2010/0314418 | A1 | 12/2010 | Roth | | |

* cited by examiner

COVER DEVICE FOR A DRINK CONTAINER

This application is the U.S. National Phase application under 35 U.S.C. § 371 of International Application No. PCT/EP2015/054226, filed on Jun. 4, 2015, which claims the benefit of U.S. Provisional Application No. 62/011,353 filed on Jun. 12, 2014. These applications are hereby incorporated by reference herein.

FIELD OF THE INVENTION

The present invention relates to a cover device for a drink container, comprising a basic assembly having a drink opening, and a valve arrangement. In an embodiment, the valve arrangement is associated with the basic assembly, and is adapted to assume various states for determining an extent to which a passage to the drink opening in the basic assembly from a side of the cover device which is intended to face the drink container is blocked.

The present invention also relates to an assembly of a drink container and a cover device as mentioned, wherein the cover device is removably attached to the drink container.

BACKGROUND OF THE INVENTION

Applicant's earlier non-prepublished application WO2014/086625 describes a cover device for a drink container comprising a basic assembly which is provided with a drink opening and a valve arrangement for blocking or unblocking a passage to the drink opening from a drink container side of the cover device. The valve arrangement comprises a valve element having two portions which are connected to each other through an area of the valve element at a position where the valve element is hingably associated with the basic assembly, and wherein only one of the two portions is in direct communication with the drink opening of the basic assembly, so that a smallest total moment of force may be realized on the one portion when the valve element is subjected to pressure from the drink container side of the cover device. In the central portion a slit is present which will open upon suction force.

The thin material of the valve element at the location of the slit valve deforms when overpressure is present in the drink container on the valve element, sometimes resulting in opening of the slit valve. Overpressure occurs e.g. when the drink container is held upside down or is shaken.

These and other aspects of the invention will be apparent from and elucidated with reference to the embodiments described hereinafter.

SUMMARY OF THE INVENTION

It is an object of the present invention to further improve the leak resistance of the cover device for a drink container. The invention is defined by the independent claims. Advantageous embodiments are defined in the dependent claims. In an embodiment, a valve arrangement is present which can easily be opened by a user exerting a vacuum force while being capable of realizing a leakproof seal of the drink container in case the valve arrangement is subjected to pressure at the container side thereof. An embodiment provides a cover device for a drink container, comprising a basic assembly which is provided with at least one drink opening, and a valve arrangement which is associated with the basic assembly, which is adapted to assume various states for determining an extent to which a passage to the drink opening in the basic assembly from a side of the cover device which is intended to face the drink container is blocked, wherein the valve arrangement comprises an element which is hingably associated with a supporting surface portion of the basic assembly, wherein the valve element has two portions which are connected to each other through an area of the valve element which is present at a position where the valve element is hingably associated with the supporting surface portion of the basic assembly, and wherein only one of the two portions of the valve element is in direct communication with the drink opening of the basic assembly.

The cover device according to the present invention comprises a basic assembly having a drink opening and a connecting member and a valve arrangement comprising a valve element, wherein the valve element has a slit, and wherein at least one of the valve element and the connecting member is shaped in such a way that the tighter the valve element is pushed onto the connecting member, the more firmly the slit is closed.

When the drink container is shaken or held upside-down, an increased pressure acts on the valve element in the direction of the drink opening. The valve element is thereby pushed in an outward direction towards the drink opening of the basic assembly. By shaping the valve element and/or the connecting member, such that the tighter the valve element is pushed onto the connecting member, the more firmly the slit is closed, the valve element is closed more tightly when an increased pressure acts on the valve element.

In a preferred embodiment the valve element has a slanted shape at the location of the connecting member, wherein the slanted shape at least partially extends beyond a part of the valve element that overlaps with the connecting member in a normal operating state, also called rest position.

The slanted shape enables a smooth sliding of the valve element over the connecting member. When the slanted shape is present at the valve element where the valve element and the connecting member connect, the valve element does not have to overcome a change in slope—what would be the case, when the valve element would connect to the connecting member outside of the slanted shape—thus lowering the threshold for increasing the closing force between the two portions of the slit.

In another embodiment the connecting member has a slanted slope that at least partially extends beyond a part of the valve element that overlaps with the connecting member in a normal operating state, also called rest position.

The slanted shape enables a smooth sliding of the valve element over the connecting member. When the slanted shape is present at the connecting member where the valve element and the connecting member connect, the valve element does not have to overcome a change in slope—what would be the case, when the valve element would connect to the connecting member outside of the slanted shape—thus lowering the threshold for increasing the closing force between the two portions of the slit.

Advantageously the valve element has more than one strengthening ribs that provide the valve element with the slanted shape.

Advantageously the connecting member is a ring-shaped member.

Preferably the strengthening ribs are rotationally symmetrically arranged around a center of the valve element.

The above-described and other aspects of the present invention will be apparent from and elucidated with reference to the following detailed description of a number of embodiments of a cover device for a drink container.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
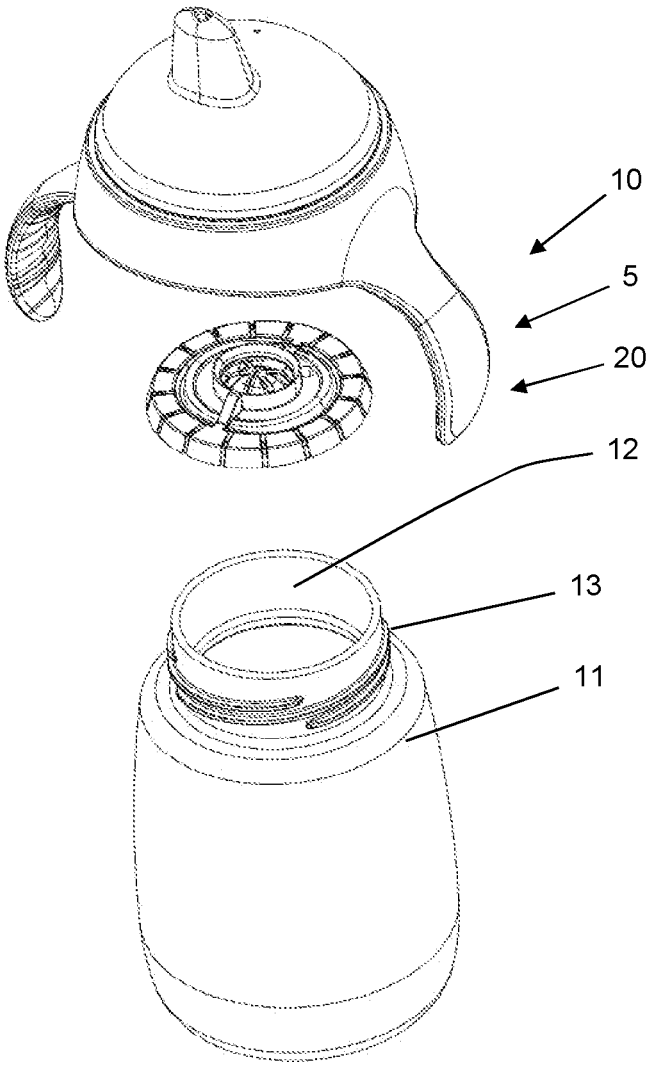
FIG. 1 shows an exploded view of a top portion of a drink bottle and a cover device according to an embodiment of the present invention.

FIGS. 1-5 relate to a cover device 5 according to an embodiment of the present invention. In general, the cover device 5 is intended to be used for covering an open side 12 of a drink container such as a drink bottle 11, wherein the cover device 5 has a function in avoiding spillage of liquid from the drink container 11. However, the cover device 5 is not just a cover having a sealing function. Instead, the cover device 5 comprises a valve arrangement 20 which is adapted to prevent liquid from flowing from an interior of the drink container 11 to outside of the drink container 11 through the cover device 5 in a closed state, and to allow a flow of liquid to pass through in an open state. In this way, it is possible to allow a user of an assembly 10 of the cover device 5 and the drink container 11 to drink from the drink container 11 if so desired without a need of removing the cover device 5, while the cover device 5 can perform a sealing function on the drink container 11 in all other circumstances.

Figure 2:
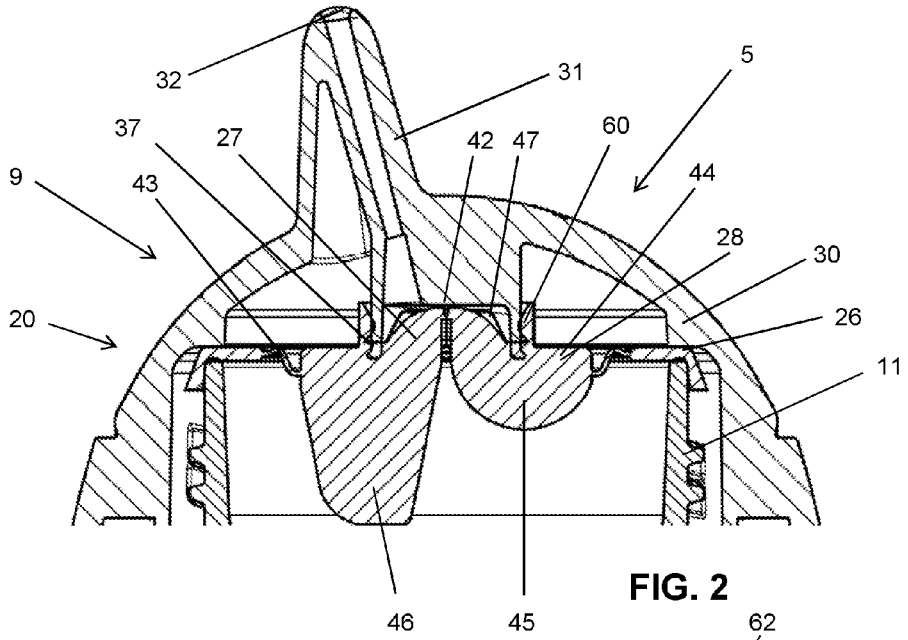
FIG. 2 illustrates a cross-sectional view of a cover device according to an embodiment of the present invention.
Figure 3:
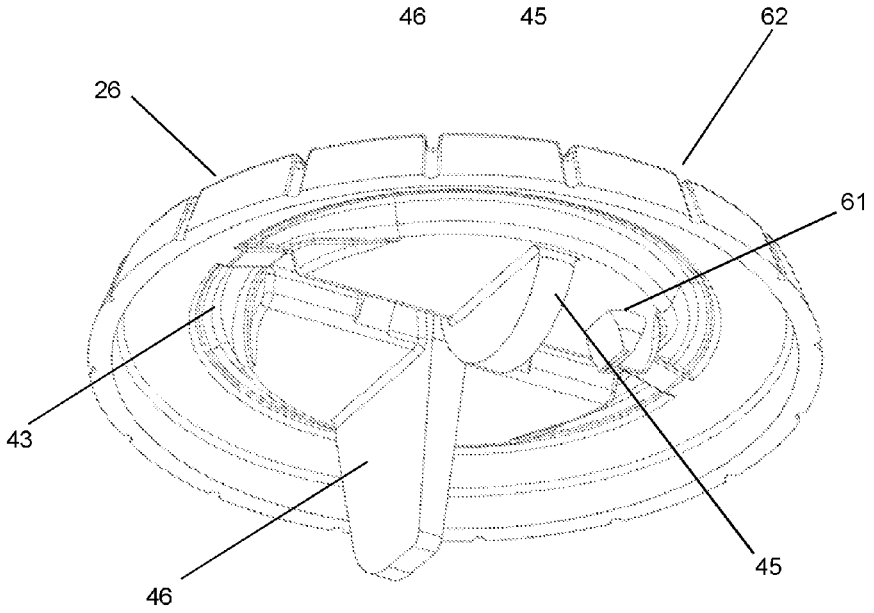
FIGS. 3 and 4 show perspective views of a valve arrangement of a cover device according to an embodiment of the present invention.
Figure 4:
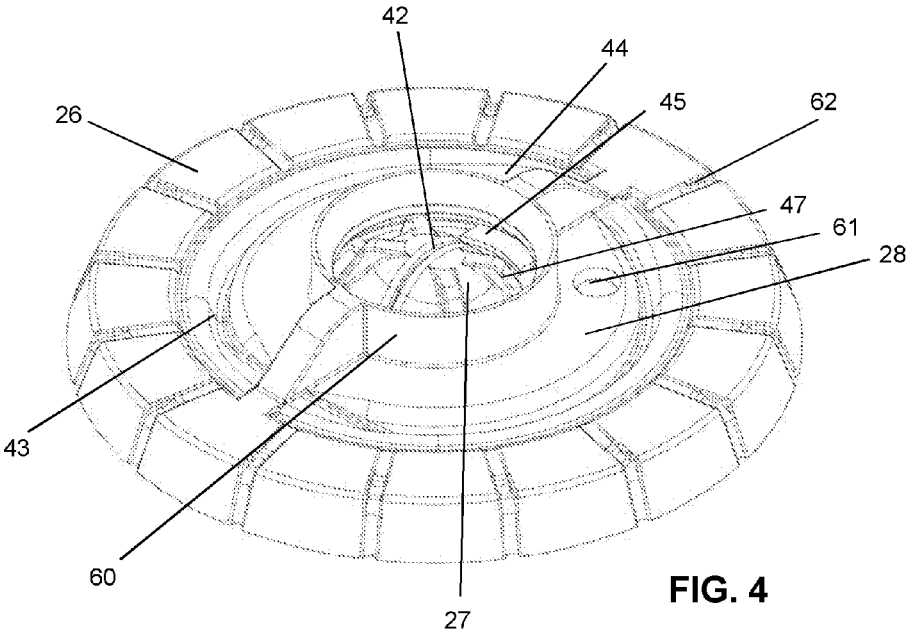
Figure 5:
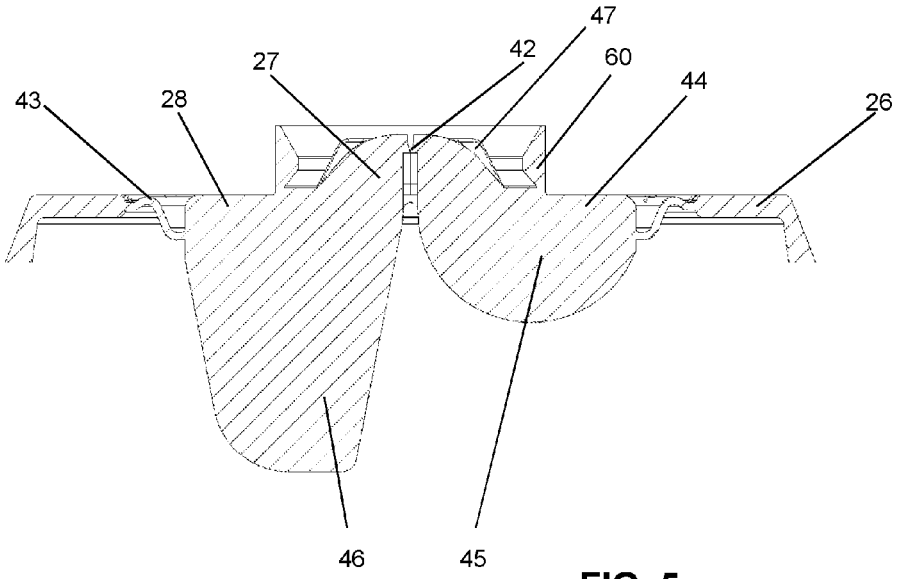
FIG. 5 shows a sectional view of a valve arrangement of a cover device according to an embodiment of the present invention.

The cover device 5 comprises a housing 30 and a spout 31 which projects from the housing 30, wherein the spout 31 comprises at least one drink opening 32 and is intended to be inserted into the mouth of the user. It is noted that an assembly of the housing 30 and the spout 31 is also referred to as basic assembly 9 of the cover device 5. When the user exerts a sucking force on the spout 31, an underpressure is obtained in the spout 31 as a result thereof, which causes the valve arrangement 20 to open and allow the drink to pass from the drink container 11 to the user's mouth, wherein it is assumed that the user keeps the drink container 11 in a tilted orientation so that the drink is present at the location of the cover device 5. The details of the valve arrangement 20 will be explained later. FIG. 2

Within the framework of the present invention, the cover device 5 and the drink container 11 can be provided with any suitable type of means for allowing the cover device 5 and the drink container 11 to be attached to each other or to be detached from each other, dependent on the user's desires. For example, both the cover device 5 and the drink container 11 can be provided with screw thread, wherein the drink container 11 can be provided with external screw thread 13 as shown in FIG. 1, and wherein the housing 30 of the cover device 5 can provided with internal screw thread for engaging with the external screw thread 13 of the drink container 11.

The cover device 5 comprises a basic assembly 9 including a housing 30 and a pout 31, which comprises at least one drink opening 32, and a valve arrangement 20. The valve arrangement 20 comprises a valve element 26. The housing 30 comprises a connecting member 37 which serves for locally supporting the valve element 26 at a position between an inner periphery and an outer periphery of the valve element 26. In this embodiment the connecting member is a ring-shaped member. However, the connecting member may also be ovally-shaped, square-shaped, rectangularly-shaped or even comprise two linear, parallelly arranged portions extending from the base of the spout. The valve element 26 is arranged at the base of the spout 31. In particular, tt*) a connecting member 37 contacts the valve element 26 only through a small area, so that a hinge contact is realized. Furthermore, the hinge contact between the valve element 26 and the ring-shaped member 37 of the housing 30 allows for changes in the position/orientation of the valve element 26 in the cover device 5 when pressure is exerted.

The ring-shaped member 37 of the housing 30 divides the valve element 26 into two portions, as it were, namely a central portion 27 and an outer ring portion 28. As can be seen in FIG. 2, the central portion 27 is located in an interior space of the housing 30 which is in direct communication with the spout 31, whereas the outer ring-shaped portion 28 is separated from that interior space by the ring-shaped member 37. In other words, the central portion 27 is in direct communication with the drink opening 32 of the spout 31, whereas the outer ring-shaped portion 28 is not. As a consequence, when the user exerts a suction force on the spout 31 and thereby creates an underpressure in the spout 31, only the central portion 27 is under the influence of that underpressure, wherein the pressure difference across the central portion 27 causes a deformation and a tilting movement of the valve element 26, so that two sides of the slit 42 are pulled away from each other and the sealing contact of the slit 42 is lost. At that point, the valve arrangement 20 is in the open state. In order to enhance the tilting effect of the central portion 27, the outer ring-shaped portion 28 comprises a corrugated portion 43, so that a change of orientation of the central portion 27 does not require much force.

Another situation is obtained when overpressure is obtained inside the drink container 11, which may be the case when the drink container 11 is shaken or falls down, for example, in a situation in which the drink container 11 is filled to at least some extent. In the situation of overpressure as mentioned, a pressure difference is obtained across both the central portion 27 and the outer ring-shaped portion 28 of the valve element 26, as both portions 27, 28 are in communication with the interior of the drink container 11. The outer ring-shaped portion 28 is pressed in a direction of the spout 31 of the housing 30, and is deformed in such a way as to move into the interior space which is present between the drink container 11 and the ring-shaped member 37. The central portion 27 is under the influence of two factors, namely the pressure difference as mentioned and tensions which are a result of the deformation of the outer ring-shaped portion 28. The first factor tends to cause central portion 27 to assume a position in which the sealing contact between the two sides of the slit 42 are lost, whereas the second factor tends to cause the central portion 27 to tilt in the direction of the drink container 11 and assume a position in which the sealing contact to between the two sides of the slit 42 is intensified. The design of the valve element 26 is chosen such that the second factor is the strongest factor, so that a closed state of the valve arrangement 20 is guaranteed in the situation of overpressure prevailing at the side of the cover device 5 facing the drink container 11. Among other things, a design factor contributing to the influence of the outer ring-shaped portion 28 on the central portion 27 is the presence of one or more strengthening ribs 45,46 in the valve element 26 at the location of the hinge contact to the ring-shaped member 37 of the housing 30, by means of which a lever effect of the outer ring-shaped portion 28 on the central portion 27 is enhanced.

The closed state of the valve arrangement 20 is obtained on the basis of sealing contact of the two sides of a slit 42 provided in the valve element 26. The slit 42 is present in a dome-shaped, central portion 27 of the valve element 26. Thus, it is achieved that the central portion 27 having the slit 42 is in direct communication with the drink opening 32 of the spout 31, as shown in FIG. 2, whereas the outer ring-shaped portion 28 is not, as communication between the latter portion 28 and the drink opening 32 is blocked at a location where the valve element 26 hingably contacts the base of the spout 31, which is the location where the distinction between the central portion 27 and the outer ring-shaped portion 28 is made. Communication between the outer ring-shaped portion 28 and the drink opening 32 is also prevented by the presence of a sleeve 60, which encloses or is enclosed by the ring-shaped portion 37 at the base of the spout 31. In the embodiment shown in FIG. 2 the sleeve 60 encloses the ring-shaped portion 37. However, the opposite situation, the ring-shaped portion 37 surrounding the sleeve 60 is also an option having a similar effect, namely preventing communication of fluid between the outer ring-shaped portion 28 and the drink opening 32.

The valve element 26 is provided with a valve 61 for allowing air to pass from one side of the element to the other. The valve 61 comprises a duckbill, for example. The valve 61 for allowing air to pass is arranged in the outer ring-shaped portion 28. The valve element 26 can also be provided with at least one, but preferably more than one, air channel 62. The air channels 62 for allowing air to pass are arranged on the edge of the valve element 26. The air channels 62 are suitable for air to pass, but are too small for liquid to flow from an interior of the drinking container 11 to outside of the interior of the drinking container 11. The valve element 26 can be provided with one or more air valves 61, with one or more air channels 61 or with a combination of both.

FIG. 2 illustrates how the valve element 26 is positioned with respect to the spout 31, and shows that the dome-shaped central portion 27 of the valve element 26 is present inside the spout 31 at the base of the spout 31. A sleeve 60 surrounds the central portion 27 of the valve element 26. The sleeve 60 is positioned around the ring-shaped member 37. The valve element 26 is held in its position and is prevented from moving by the sleeve 60 and the tight space between the drink container 11 and the cover device 5. For sake of completeness, it is noted that the valve element 26 may be retained inside the cover device 5 in any suitable manner, for example through a connection to the housing 30 at a position close to its outer periphery, or by means of a separate retainer.

Figure 6:
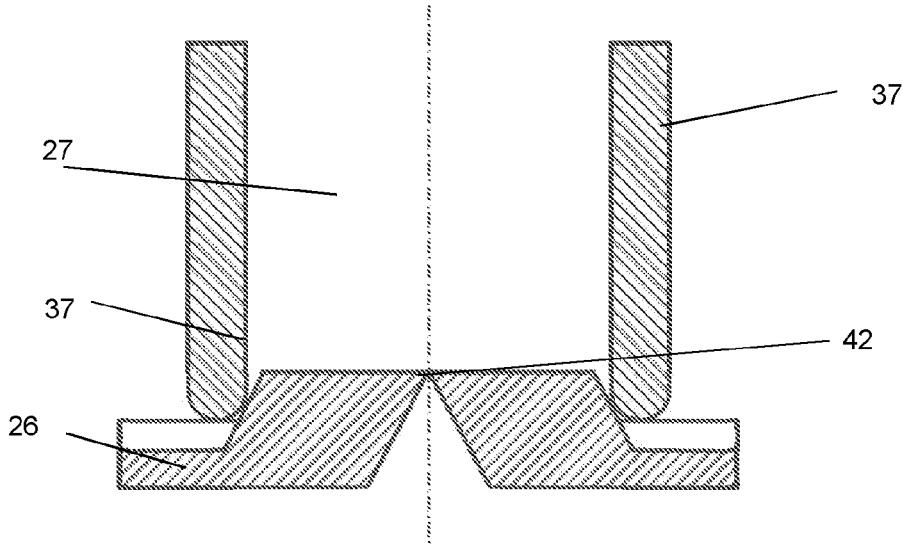
FIGS. 6, 7 and 8 show schematic cross-sectional views of a cover device in a rest position, upon suction from the drink opening and overpressure in the drink container respectively according to an embodiment of the present invention.

As illustrated in FIG. 6, in a rest position of the valve element 26 in the cover device 5, the slit 42 is closed. The valve element 26, and more specifically the strengthening ribs 47, have a slanted shape. The valve element 26 rests with its slanted shape on the connecting member 37.

Figure 7:
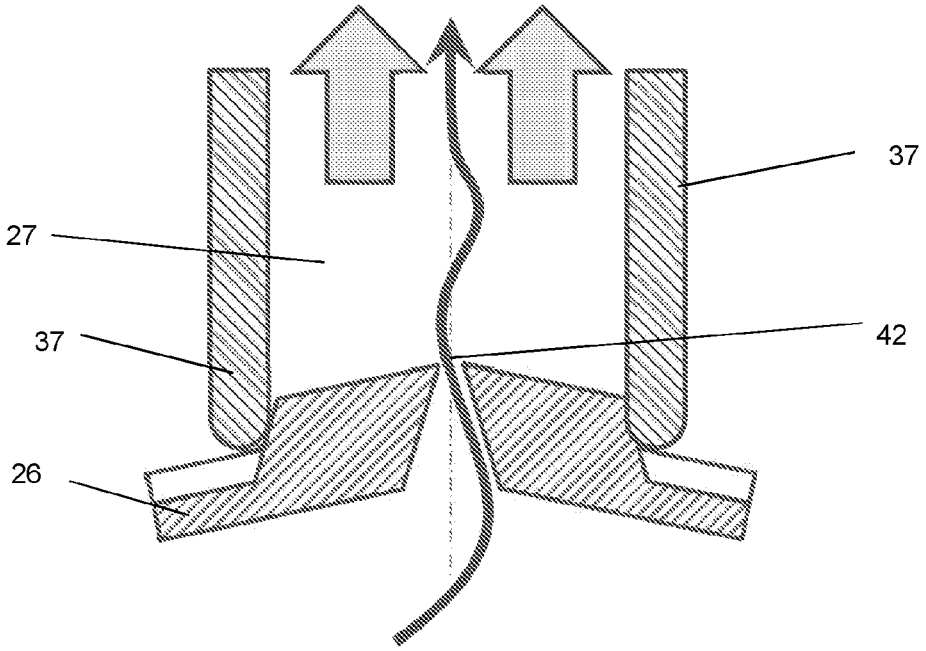

When the spout 31 is subjected to a suction action, as illustrated in FIG. 7 and underpressure is prevailing in the spout 31 as a result thereof, a pressure difference is obtained across the valve element 26, which acts on the central portion 27 of the valve element 26. As a result, the central portion 27 is deformed as it is pulled further into the spout 31 to some extent, wherein the slit 42 automatically opens in view of the fact that portions surrounding the slit 42 are pulled apart, as it were. In this state, there is an open passage from one side of the valve element 26 to another, so that liquid may pass from the container side of the valve element 26 to the spout side. The slanted shape of the valve element 26 contributes to an easy or smooth opening of the slit, by the slanted shape diverging in a rest position from the connecting member Due to the underpressure in the drinking container 11, caused by the suction action performed by a user through the drink opening 32 and the resulting open state of the valve arrangement 20, the air valve 61 opens so that the underpressure can be normalized due to an aeration effect. The underpressure can also be normalised by the air channels 62.

Figure 8:
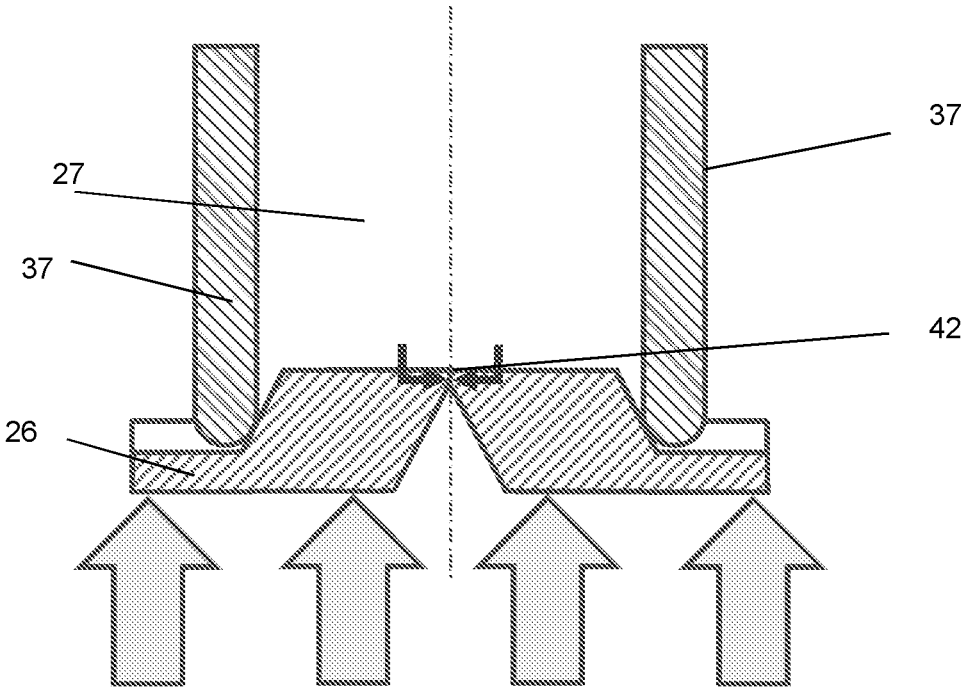

In a situation of overpressure at the container side of the valve element 26, as illustrated in FIG. 8 the slit 42 is closed as well, wherein an extra tight closure is realized under the influence of tensions prevailing in the valve element 26. In particular, in such a situation, a pressure difference is prevailing across the entire valve element 26, i.e. across both the central portion 27 and the outer ring-shaped portion 28. Under the influence of this pressure difference, the outer ring-shaped portion 28 is deformed to a considerable extent. The base of the spout 31 projects inside the housing 30 along a certain distance, and the outer ring-shaped portion 28 is pressed in a direction towards the basic assembly 9, thereby moving in a space which is present between the outer ring-shaped portion 28 and the housing 30 due to the projecting arrangement of the spout 31. In a situation of overpressure the slanted shape of the valve element 26 enables a smooth movement of the valve element 26 in the interior space towards the drink opening 32, thereby compressing the portions of the slit 42 towards each other, as indicated by the small arrows in FIG. 9. Tilting of the two portions of the valve element 26 is prevented by at the strengthening ribs 45,46. The outer ring-shaped portion 28 may be provided with a corrugated portion 43 as is the case in the shown example, for locally weakening the outer ring-shaped portion 28 and guaranteeing a tilting movement of a portion 44 of the outer ring-shaped portion 28 as present between the corrugated portion 43 and the contact between the base of the spout 31 and the valve element 26. The tilting movement is continued in the central portion 27 of the valve element 26, wherein portions delimiting the slit 42 are tilted and deformed, as a result of which the central portion 27 is flattened. As a result, the slit 42 is firmly closed, and a sealing function of the valve arrangement 20 as desired in the situation of overpressure is realized. The valve element 26 includes a number of strengthening ribs 45,46,47 as is the case in the shown example, so that the lever action of the outer ring-shaped portion 28 on the central portion 27 and consequently the closing of the slit 42 may be guaranteed despite of the flexibility of the valve element 26. The number of strengthening ribs 45,46,47 may vary dependent on for example the thickness of the valve element 26, the length in radial length and the width in tangential direction of the strenthening ribs. In the fifth embodiment the strengthening ribs 45,46,47 to support the lever action are located on the bottle side of the valve element 26 and on central portion 27. It is the objective of the strengthening ribs 45,46 to support the lever action of the secondary portion 28 on the primary portion 27 which is supposed to take place when overpressure is prevailing in a drink container 11 as covered by the cover device 5. The strengthening ribs 47 on the central portion 27 of the valve element 26 support the slit 42 in closing upon underpressure in the drink container 11. One of the strengthening ribs 46 may be an elongated strengthening rib 46, such that the rib 46 extends further from the valve element 26. The elongated strengthening rib 46 functions as a handle. The handle 46 enables a user to easily remove the valve element 26 from the cover device 5. The user can then easily clean the valve element 26 and the cover device 5.

Cover device 5 for a drink container 11 comprises a basic assembly 9 which is provided with at least one drink opening 32 and a ring-shaped portion 37. In a practical embodiment, the basic assembly 9 may comprise a housing 30 and a spout 31 which projects from the housing 30 and which has the drink opening 32 at a free end thereof. The cover device 5 further comprises a valve arrangement 20 which is adapted to assume a closed state for blocking a passage to the drink opening 32 in the basic assembly 9 from a side of the cover device 5 which is intended to face the drink container 11, and to assume an opened state for unblocking the passage as mentioned. In particular, the valve arrangement 20 comprises a valve element 26 comprising a sleeve 60 and a slit 42, a circumference of the sleeve 60 being substantially similar to a circumference of the ring-shaped portion 37. The leak resistance of the valve arrangement is further improved in that the sleeve 60 and the ring-shaped portion 37 have a first diameter in the direction of the slit 42 and a second diameter perpendicular to the slit 42, wherein a ratio between the first and second diameters of the sleeve 60 is smaller than a ratio between the first and second diameters of the ring-shaped portion 37.

The valve arrangement 20 comprises a valve element 26 having portions 27, 28 which are connected to each other through an area of the valve element 26 at a position where the valve element 26 is hingably associated with the basic assembly 9, wherein only one of the portions 27, 28 of the valve element 26 is in direct communication with the drink opening 32 of the basic assembly 9, and wherein sizing, positioning and orientation of the portions 27, 28 of the valve element 26 are realized for having a smaller total moment of force on a portion 27 of the valve element 26 which is in direct communication with the drink opening 32 of the basic assembly 9 than on another portion 28 of the valve element 26 not being in direct communication with the drink opening 32, when to valve element 26 is subjected to pressure from the side of the cover device 5 which is intended to face the drink container 11.

Due to the fact the only one of the two portions 27, 28 of the valve element 26 is in direct communication with the drink opening 32 of the basic assembly 9, and the other of the two portions 27, 28 is not, it is possible to have different reactions of the valve element 26 on underpressure prevailing at a side of the valve element 26 which is associated with the drink opening 32, which is realized when a user wants to drink and exerts a suction force through the drink opening 32 for that purpose, and overpressure prevailing at a drink container side of the flexible element 26 even though the pressure differences across the valve element 26 can be comparable for both situations, at least as far as their direction is concerned. Due to this fact, it is possible for the cover device 5 to have a leakproof nature, while the valve arrangement 20 can be very well responsive to a suction action, so that the user is not compelled to exert a high suction force.

The different reactions of the valve element 26 in the different situations are obtained on the basis of the fact that in the first situation, only the portion 27 of the valve element 26 which is under the direct influence of the drink opening 32 of the basic assembly 9 is addressed, whereas in the second situation, both portions 27, 28 of the valve element 26 are addressed. In particular, the design of the valve element 26 and the design of the basic assembly 9 in which the valve element 26 is accommodated are chosen such that in the second situation, the portion 27 of the valve element 26 which is under the direct influence of the drink opening 32 is exerted to a lever action by the other portion 28 wherein the lever action is stronger than the inclination of the first portion 27 to respond to a pressure difference in the same way as in the first situation. Among other things, this effect may be achieved by letting the one portion 27 be smaller than the other portion 28, provided that distances of the one portion 27 to a hinge area are not very much larger than distances of the other portion 28 to the hinge area. In general, according to the present invention, sizing, positioning and orientation of the portions 27, 28 of the valve element 26 are realized for having a smaller total moment of force on a portion 27 of the valve element 26 which is in direct communication with the drink opening 32 of the basic assembly 9 than on another portion 28 of the valve element 26 not being in direct communication with the drink opening 32, when the valve element 26 is subjected to pressure from the side of the cover device 5 which is intended to face the drink container 11.

In respect of the thresholds for opening and closing the valve arrangement 20, it is noted that the values thereof may be determined by a design factor such as the position on the valve element 26 of the hinge association with the surface portion of the basic assembly 9.

In the examples as described in the foregoing with reference to the figures, the hinge association of the valve element 26 with the supporting surface portion of the basic assembly 9 is a hinge contact. That does not alter the fact that within the framework of the present invention, it is also possible for the hinge association to be a hinge connection. For example the valve element 26 may be connected to the inner ring-shaped member 37 instead of only contacting the ring-shaped member 37, wherein the connection is at a side of the valve element 26, at a position where the hinging effect takes place. Alternatively, a ring-shaped member can be provided as a standing part of a membrane, wherein the connection is at a top edge of the ring-shaped member. The hinging effect does not necessarily need to be present at the position of the connection. For example, in the latter case, the connection may be located at the top edge of the ring-shaped member, whereas a hinge may be present at a position at a bottom edge of the ring-shaped member, i.e. a position where the ring-shaped member is attached to the membrane, wherein the hinge may be realized by letting the ring-shaped member at the bottom side be sufficiently thin, to mention one possibility. In any case, it is possible to discern a valve element 26 which is arranged for assuming different positions/appearances with respect to the basic assembly 9 and thereby controlling an extent to which a passage to the drink opening 32 of the basic assembly 9 is blocked, wherein two portions 27, 28 can be distinguished on the valve element 26 which are separated by association to another element, which may be a separate element or an integral element, as explained in the foregoing, which has a function in suspending/supporting the valve element 26 from/on a supporting surface portion of the basic assembly 9, wherein the association is such that hinging movements of the element 26 are allowed to take place under the influence of the various possible pressures acting on the element 26.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

For sake of clarity, it is noted that the terms "overpressure" and "underpressure" as used in this text are understood such as to imply a higher pressure than ambient pressure and a lower pressure than ambient pressure, respectively.

Furthermore, it is noted that the basic assembly 9 does not necessarily need to be equipped with a spout 31, as long as it is possible for a user of the cover device 5 to drink from the drink opening 32 by exerting a suction force. It is practical for the drink opening 32 to be present at an end of an element projecting from a housing 30, as is the case with a spout 31, but this is not essential within the framework of the present invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A cover device for a drink container, the cover device comprising:

a basic assembly including a housing and a spout which comprises at least one drink opening; and a valve arrangement adapted to prevent liquid from flowing from an interior of the drink container to outside of the drink container through the cover device in a closed state and to allow a flow of liquid to pass through in an open state, the valve arrangement comprising a valve element, and a ring-shaped connecting member, wherein the valve element has a slit, and wherein the valve element is arranged at the base of the spout such that such that the ring-shaped connecting member contacts the valve element to realize a hinge contact between the valve element and the ring-shaped connecting member to allow for changes in the position and orientation of the valve element in the cover device when pressure is exerted, wherein the basic assembly has a connecting member for locally supporting the valve element at a position between an inner periphery and an outer periphery of the valve element, and wherein at least one of the valve element and the connecting member is shaped in such a way that the tighter the valve element is pushed onto the connecting member when an increased pressure acts on the valve element in a direction of the drink opening, the more firmly the slit is closed.

2. The cover device according to claim 1, wherein the valve element has a slanted shape at a location of the connecting member, wherein the slanted shape at least partially extends beyond a part of the valve element that overlaps with the connecting member in a rest position.

3. The cover device according to claim 2, wherein the valve element has more than one strengthening ribs that provide the valve element with the slanted shape.

4. The cover device according to claim 3, wherein the strengthening ribs are rotational symmetrically arranged around a center of the valve element.

5. The cover device according to claim 1, wherein the connecting member has a slanted slope that at least partially extends beyond a part of the connecting member that overlaps with the valve element in a rest position.

6. An assembly of a drink container and a cover device according to claim 1, wherein the cover device is removably attached to the drink container.

* * * * *